United States Patent [19]

Allen

[11] Patent Number: 4,573,822

[45] Date of Patent: Mar. 4, 1986

[54] SHEET LIFTER FOR A LOOSE LEAF BINDER

[76] Inventor: Dell K. Allen, 195 S. Inglewood Dr., Orem, Utah 84057

[21] Appl. No.: 583,769

[22] Filed: Feb. 27, 1984

[51] Int. Cl.[4] ..... B42F 13/00

[52] U.S. Cl. ..... 402/80 L; 402/24

[58] Field of Search ..... 402/24, 80 L, 31

[56] References Cited

U.S. PATENT DOCUMENTS

| | | | |
|---|---|---|---|
| 2,035,284 | 3/1936 | Trussell | 129/4 |
| 2,089,211 | 8/1937 | Krag | 402/80 L |
| 2,179,757 | 11/1939 | Schade | 129/4 |
| 2,179,986 | 11/1939 | Trussell | 129/4 |
| 2,276,987 | 3/1942 | Kengott | 129/4 |
| 3,306,301 | 2/1967 | Mason | 129/4 |
| 3,591,300 | 6/1971 | Beyer | 402/80 A |

*Primary Examiner*—Paul A. Bell

*Assistant Examiner*—Taylor J. Ross

*Attorney, Agent, or Firm*—Workman, Nydegger & Jensen

[57] ABSTRACT

A leaf-lifter device to be used in connection with ring binders so that the loose-leaf pages in the binder do not bind under the rings of the binder when the loose leaf is closed. In one preferred embodiment the apparatus is comprised of seven parallel strips of plastic connected to one another by a flexible, thin plastic membrane which forms a hinge. Each of the two outside parallel strips are mounted to the adjacent outer leaf of the binder. The inner or center strip is mounted to the binder spring plate. The intermediate strips are not attached to the binder so that as the binder is closed the two intermediate strips will buckle at their hinged edges and will thus lift the loose-leaf pages so that they avoid binding and tearing under the binder rings.

14 Claims, 6 Drawing Figures

SHEET LIFTER FOR A LOOSE LEAF BINDER

BACKGROUND

1. Field of the Invention

This invention relates to sheet lifters which are used to facilitate the closing of loose leaf binders such that the pages which are secured in the loose leaf will not bind and tear when the loose leaf is closed.

2. The Prior Art

Loose leaf binders have long been used as a practical and convenient means of securing individual pages or sheets of paper in a convenient fashion so that the pages can be removed or replaced from time to time. It is not uncommon when using loose leaf binders that when the outer leaves of the binder are closed the pages or sheets are caught between the rings of the binder and the outer leaves thus making it difficult to close the loose leaf and sometimes tearing the outermost pages.

There have been several attempts in the prior art to solve this problem. Typically, sheet lifters are secured to the rings of the binder such that the pages or sheets are supported by the sheet lifters at each of the rings. The function of the sheet lifters is to help move the sheets upward along the rings when the covers of the binder are closed, thus helping to prevent the sheets from being caught between the rings and the outer leaves of the loose leaf when the leaves are folded together so as to close the loose leaf.

One of the most common types of prior art leaf lifter devices is illustrated in FIG. 1 and is disclosed in U.S. Pat. No. 3,591,300. The loose leaf binder generally designated at 14 includes a backing or spine 15 to which two cover leaves 16 and 17 are hinged as at 18 and 19. The loose leaf binder includes a plurality of rings generally designated 12, of which only one is shown in FIG. 1. Each ring comprises two arcuate segments 12*a* and 12*b* which mate at the uppermost ends thereof when in the closed position. The lower ends of the arcuate ring segments 12*a* and 12*b* are connected to a spring mechanism (not shown) to provide the conventional snap-action which is used to open or close the rings when it is desired to insert or remove pages. The spring mechanism is housed by a longitudinal cover plate 20 securely attached to the inside surface of the spine 15.

The prior art type leaf lifter of this device is typically constructed of molded plastic. The device includes two parts generally designated at 26 and 28 which are of identical construction and which are joined by an integral connection 29. The two sheet lifter parts 26 and 28 each include a flat body portion 30 which includes an upwardly inclined portion 32 which is connected at a score line or groove 52 to the connector 29. Formed on the body portion 30 are narrow tracks 42 and 43 which are inclined at the end where the sheet lifter parts 26 and 28 are joined to the connector 29.

In its operation, as the outer leaves 16 and 17 of the loose leaf are closed sheet lifter parts 26 and 28 help raise the pages along the rings 12 in order to prevent them from binding.

While in many respects this type of prior art leaf lifter works well, it also suffers from certain disadvantages. For example, one of the problems with this type of leaf lifter is that sheet lifter parts 26 and 28 can themselves at times bind so that they do not slide freely along the rings 12 thus making it difficult to close the loose leaf. Also, the connector portion 29 is relatively cumbersome and tends to take up unnecessary space, both in the open and closed positions of the loose leaf. Another disadvantage with this type of prior art leaf lifter is that when the outer leaves 16 and 17 are folded, the outermost edges 34 of the sheet lifter parts 26 and 28 are lifted first. This necessitates that the sheet lifter parts 26 and 28 be inclined as at tracks 42 and 43 in order to also lift the pages and prevent them from binding, which even then is not always successful.

Other similar types of prior art leaf lifter devices have been known and described in the prior art. See, for example, U.S. Pat. Nos. 3,306,301, 2,276,987, 2,179,986, 2,179,757, and 2,035,284. While the various leaf lifter devices mentioned in these patents are all somewhat different from one another, they are similar to the leaf lifter device illustrated in FIG. 1 in that they are typically secured about the rings of the loose leaf binder and they necessitate that the outer edges of the sheet lifter be lifted as the outer leaves of the loose leaf are closed. Thus, these prior art type leaf lifters suffer from many of the same or similar disadvantages as those mentioned above in connection with the device illustrated in FIG. 1.

OBJECTS AND BRIEF SUMMARY OF THE INVENTION

It is a principal object of the present invention to provide a leaf lifter device which overcomes and eliminates the problems heretofore experienced with the prior art type devices. In particular, it is a primary object of the present invention to provide an apparatus for lifting the pages or sheets of a loose leaf in a manner so as to avoid binding and tearing the sheets as the outer leaves of the loose leaf are closed.

Another important object of the present invention is to provide a leaf lifter device which is very simple and streamlined in its construction so as not to take up unnecessary space.

Yet another important object of the present invention is to provide a leaf lifter device which is not required to be secured about the rings of the binder and which thus can lift the pages of the loose leaf without itself becoming caught between the rings and the outer leaves of the binder.

Still another object of the present invention is to provide a leaf lifter device which is inexpensive to manufacture and which can be used with virtually any loose leaf, regardless of the number or size of rings used in the loose leaf.

These and other objects and features of the present invention will become more fully apparent from the following description and appended claims taken in conjunction with the accompanying drawings.

The present invention provides a novel device for lifting the pages or sheets which are secured in a loose leaf binder so as to prevent the pages from being caught and/or from tearing as the outer leaves of the binder are closed. The invention comprises a flexible member which has one edge securely attached to the inside of the spine of the loose leaf while an opposite edge is attached to the inside surface of one of the outer leaves of the loose leaf. As the outer leaf is folded, the middle portion of the flexible member buckles so as to raise the pages of the loose leaf upwards and along the rings. When the outer leaves are fully opened, the flexible member flattens out. As hereinafter more fully described, the leaf lifter device of this invention can be embodied in several different forms which accomplish the same results without departing from the spirit or essential characteristics of the invention.

BRIEF DESCRIPTION OF THE DRAWINGS

Reference is next made to a more detailed description of the presently preferred embodiments of the invention as illustrated in the drawings, wherein like parts are designated with like numerals throughout.

DETAILED DESCRIPTION OF THE PRESENTLY PREFERRED EMBODIMENTS

Figure 2:
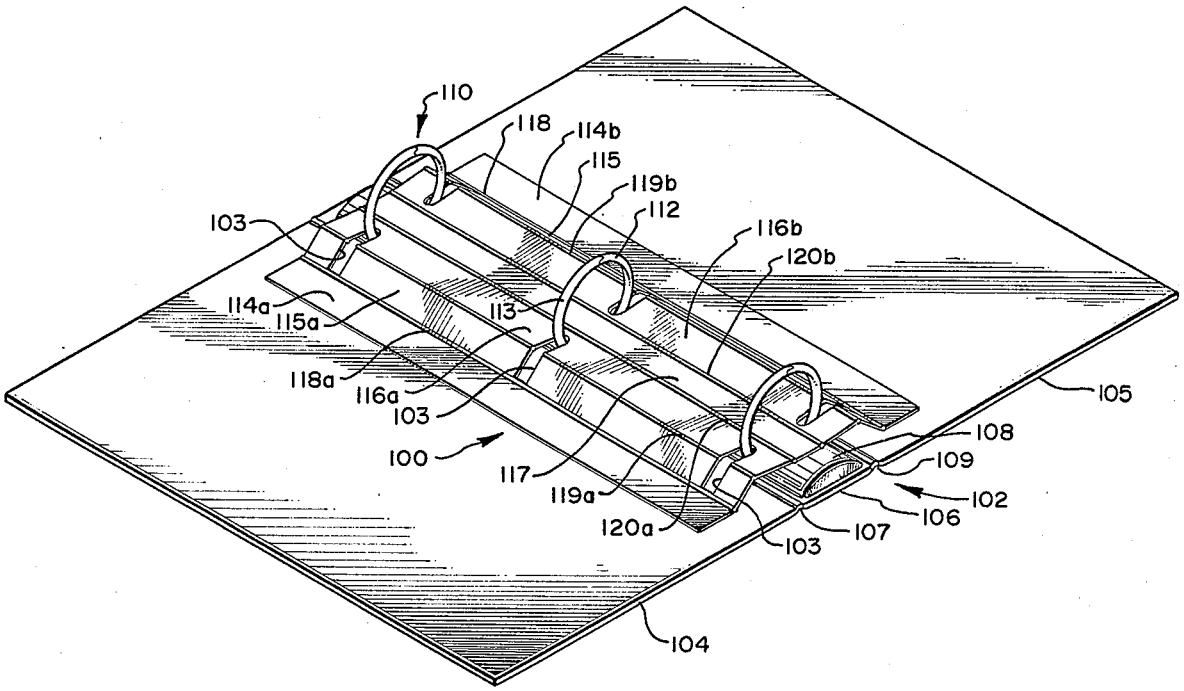
FIG. 2 is a perspective view illustrating one presently preferred embodiment of the leaf lifter apparatus of the present invention as used in conjunction with a conventional three-ring loose leaf binder.

Reference is first made to FIG. 2, which illustrates the leaf lifter device generally designated at 100 used in connection with a conventional three-ring loose leaf binder generally designated at 102. The loose leaf 102 consists of the outer leaves 104 and 105 which are connected by hinges 107 and 109 to a back or spine 106. Mounted on the spine 106 is a spring plate 108 which encloses a spring mechanism (not shown) which is used to provide the conventional snap action of the rings generally designated at 110. Each of the rings 110 has two arcuate sections 112 and 113 which may be opened and closed to permit insertion and removal of the individual pages 109 (see FIG. 4) which are secured by the rings 110.

Figure 3:
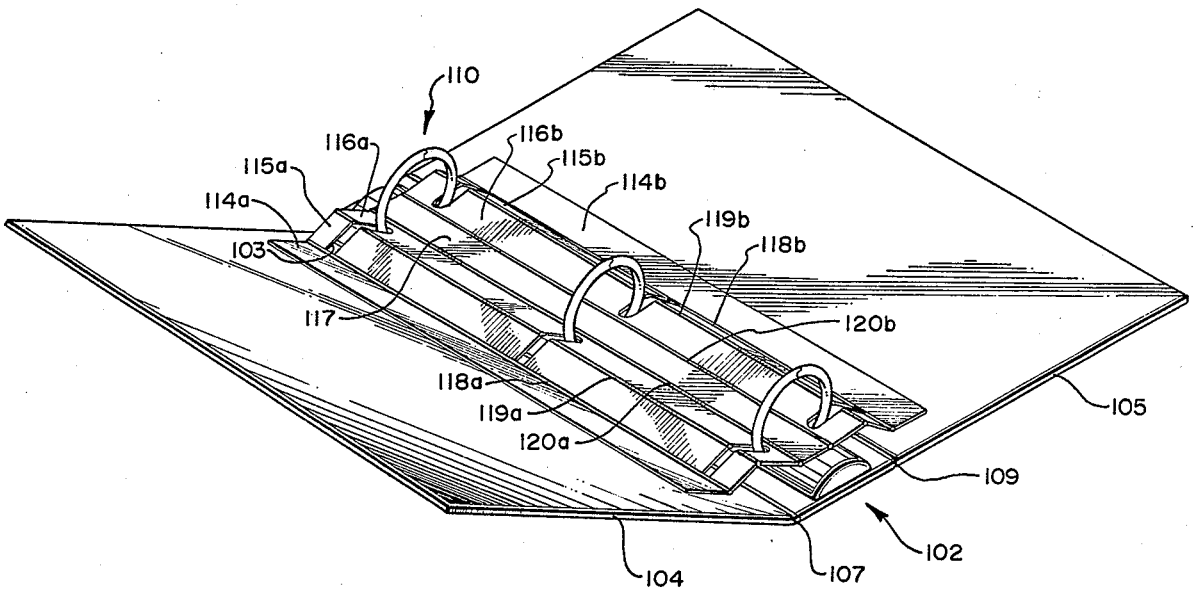
FIG. 3 is a perspective view of the leaf lifter of the current invention.
Figure 4:
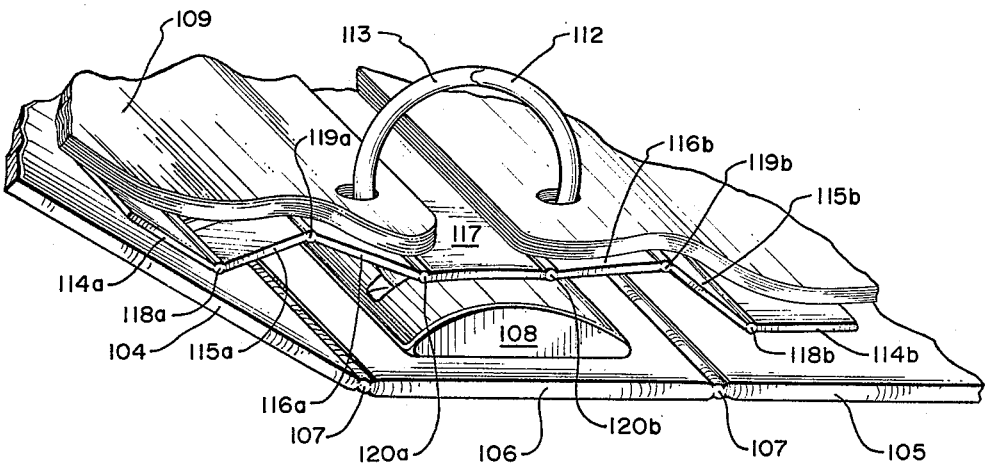
FIG. 4 is an enlarged perspective view which illustrates more particularly how the pages of the loose leaf are lifted as the outer leaves are folded to the closed position.

In the embodiment illustrated in FIGS. 2–4, the leaf lifter device 100 comprises a flexible member which is formed using three long, rectangular strips of material 114*a*–116*a* and 114*b*–116*b* which may be hingedly connected on each side of the loose leaf 102. The three hinged strips 114*a*–116*a* and 114*b*–116*b* on each side of the loose leaf are joined at the spine 106 by a middle strip 117 which is hingedly connected between strips 116*a* and 116*b*.

As shown best in FIG. 4, the strips 114–117 are joined together by hinges 118–120 which run the length of the strips. Each hinge joins two adjacent strips together, as for example strips 114 and 115 which are joined by hinge 118, strips 115 and 116 which are joined together by hinge 119 and strips 116 and 117 which are joined together by hinge 120. As hereinafter more fully described, the hinges 118–120 permit the two intermediate strips 115 and 116 to raise up as illustrated in FIG. 4 when the outer leaves 104 and 105 of the loose leaf 102 are folded to the closed position. The intermediate strips 115 and 116 each have slots 103 formed through their width so that the rings 110 will not interfere as the strips 115 and 116 lift the pages.

As shown best in FIGS. 2 and 4, the outermost strip of material 114 is securely attached to the inside surface of outer leaf 104 while the inner strip 117 is securely attached to the inside surface of spine 106 on the spring plate 108. Thus, when the outer leaves 104 and 105 are folded to the closed position, the two strips 114 and 117 are drawn together which in turn causes the two inner strips 115 and 116 to buckle and raise up by virtue of the hinges 118–120. The hinge 119 (see FIG. 4) is located so that it is positioned just below the edge of the rings 110. Thus, when the outer leaves 104 and 105 of the loose leaf 102 are folded to the closed position, the two intermediate strips of plastic 115 and 116 will push the pages upwards along the rings 110 helping to prevent them from being caught and tearing as the loose leaf is closed. When the loose leaf is fully opened so that the outer leaves 104–105 are flat, the leaf lifter device 100 of the present invention also flattens out.

In the preferred embodiment as illustrated in FIGS. 2–4, the strips of material 114–117 are preferably made of molded plastic which can be easily heat sealed or otherwise bonded or glued at the outer strip 114 to most types of plastic loose leafs. However, the type of material used is a matter of design choice based in part on the type of material used in constructing the loose leaf 102. For example, heavy cardboard or even metal could be used in some instances to form the strips 114–117.

Figure 1:
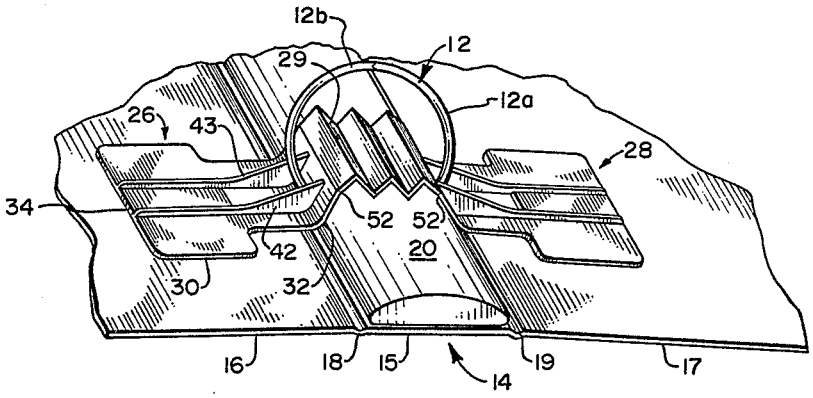
FIG. 1 (PRIOR ART)
FIG. 1 is a partial perspective view which illustrates a leaf lifter of the type heretofore commonly used in the prior art.

The hinges 118–120 are preferably molded as an integral part of the device 100 and are formed as thin plastic membranes which are flexible enough to provide the desired hinging action. It will of course be appreciated that other types of hinging mechanisms could be used to accomplish the same or similar results. For example, metal hinges could be used to join the strips of material 114–117 which could in turn be made from metal or heavy cardboard. Thus, it will be appreciated that the present invention is not limited to the particular type of materials used or to the particular embodiment illustrated in FIG. 1. For example, the hinged strips 114–117 need not be continuous in their length, and could be separated into two, three or more segments, each of which would be hinged in the same manner as previously described.

Figure 5:
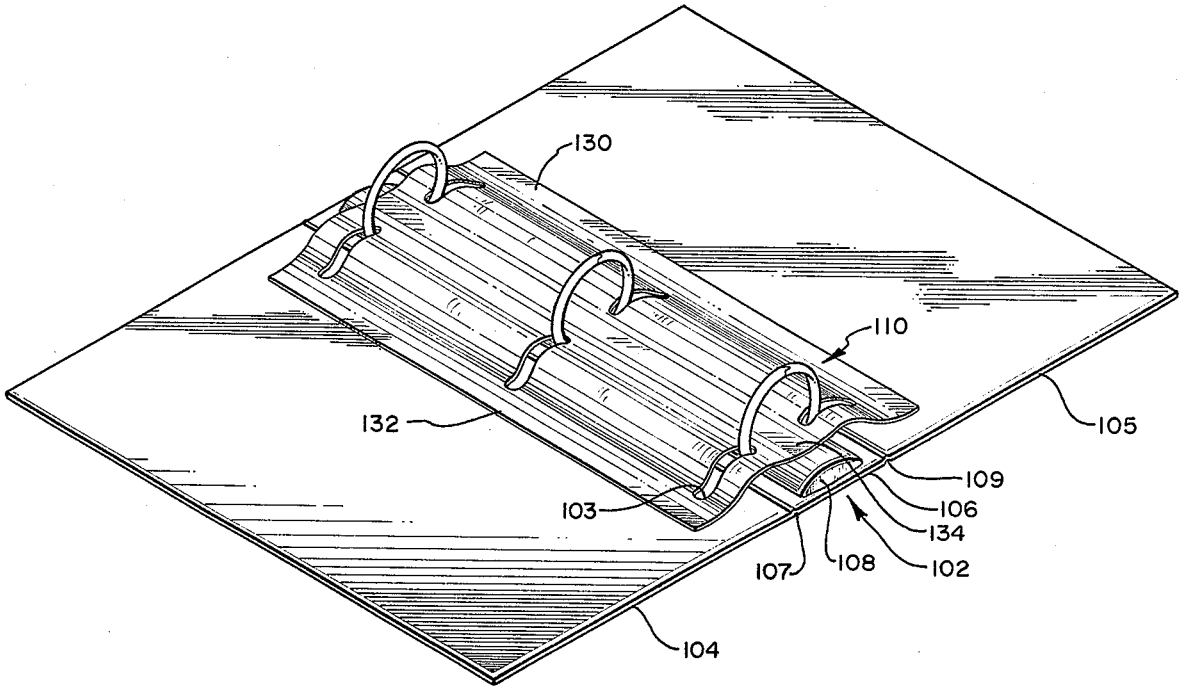
FIG. 5 is a perspective view of another embodiment of the present invention.
Figure 6:
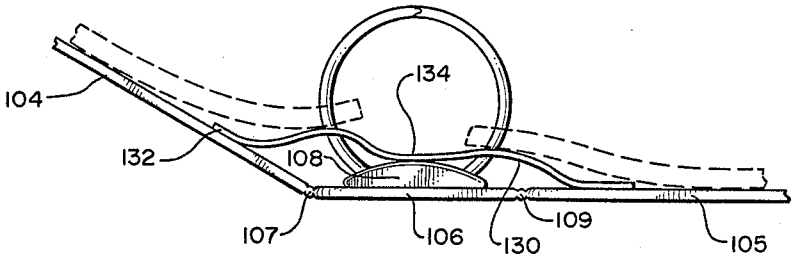
FIG. 6 is an elevated side view of the embodiment of FIG. 5.

Another embodiment of the present invention is illustrated in FIGS. 5 and 6. The embodiment includes a single sheet of material 130 which is attached along its center 134 to the spring plate 108. Each of the extreme edges of the sheet of material 132 are bonded or otherwise secured to the corresponding outer leaves 104 and 105 of the loose leaf. The sheet 130 is provided with slots 103 which serve the same purpose as in the previously described embodiment.

The sheet 130 is constructed of a material such as plastic or other material that is resilient and flexible so that when the outer leaves 104 and 105 of the lose leaf are folded together as illustrated in FIG. 6, the portion of the sheet 130 between the center 134 and outer edges 132 which are affixed will buckle and raise up so as to lift the pages as the leaves of the loose leaf are folded to the closed position.

The invention may be embodied in other specific forms without departing from its spirit or essential characteristics, and the illustrated embodiments are to be regarded in all respects as merely illustrative and not restrictive of the scope of the invention.

What is claimed and desired to be secured by U.S. Letters Patent is:

1. In a loose leaf binder comprising a pair of outer leaves joined to a spine and a plurality of rings mounted on a spring plate attached to said spine, an apparatus for lifting sheets secured by the rings of said loose leaf binder, said apparatus comprising a pair of flexible members each of said flexible members having an inner edge thereof permanently joined to said spine and an outer edge thereof permanently joined to one of said outer leaves and a middle portion defined between said edges, the middle portions of said flexible members being unattached to said spine and outer leaves such that when said outer leaves are folded to a closed position said middle portions of said flexible members will buckle so as to lift said sheets secured to said rings.

2. An apparatus as defined in claim 1 wherein each of said flexible members comprise at least a first parallel strip and a second parallel strip of material positioned adjacent and parallel with respect to one another, said strips of material being joined by a hinge at their respective adjacent edges.

3. An apparatus as defined in claim 2 wherein each of said flexible members further comprises a third parallel strip of material placed adjacent and parallel to said first strip of material and joined by a hinge to said first strip of material at the respective adjacent edges thereof, and said third strip of material being securely mounted to the inner surface of said spine.

4. An apparatus as defined in claim 3 wherein each of said flexible members further comprises a fourth strip of material securely mounted to said inner surface of said outer leaves and positioned so as to be parallel and adjacent to said second strips of material, and said fourth and second strips of material being joined by a hinge at the adjacent edges thereof.

5. An apparatus as defined in claim 1 wherein said flexible members comprise:

a first elongated strip securely mounted to the inside surface of said spine;

a second elongated strip positioned parallel and adjacent to said first strip and joined to said first strip at the adjacent edge thereof by a means for forming a hinge;

a third strip positioned parallel and adjacent to said second strip and joined at the adjacent edge thereof to said second strip by a second means forming a hinge between said second and third strips; and a fourth strip securely mounted to the inside surface of one of said outer leaves and positioned adjacent and parallel to said third strip and joined at the adjacent edge thereof to said third strip by a third means forming a hinge, whereby said second and third strips will buckle so as to lift sheets secured to said rings when said first and fourth strips are drawn together when said outer leaves are folded to a closed position.

6. An apparatus as defined in claim 5 wherein each said strip has a length which corresponds essentially to the length of said spring plate.

7. An apparatus for lifting sheets bound within a binder having a first leaf, a second leaf and a spine comprising:

a pair of first strip members;

a pair of second strip members positioned parallel and adjacent to each of said first strip members;

means for hingeably connecting each said first strip member to each of said corresponding second strip member along adjacent edges thereof;

means for permanently hingeably connecting one of said first strip members to a first leaf of said binder;

means for permanently hingeably connecting the other of said first strip members to a second leaf of said binder; and means for permanently hingeably connecting said second strip members to the spine of said binder.

8. An apparatus for lifting sheets bound within a binder as defined in claim 7, wherein said means for hingeably connecting said first strip members to said leaves of said binder comprises a pair of third strip members securely mounted to said leaves of said binder and positioned adjacent and parallel to said first strip members, and comprising means for hingeably joining said first strip member to said third strip members along adjacent edges thereof.

9. An apparatus for lifting sheets bound within a binder as defined in claim 7 wherein said means for hingeably connecting said second strip members to said spine of the binder comprises a fourth strip member securely mounted to said spine of the binder and positioned adjacent and parallel to said second strip members, and comprising means for hingeably connecting said second strip members to said fourth strip member along adjacent edges thereof.

10. An apparatus for lifting sheets bound within a binder as defined in claim 7 wherein said means for hingeably connecting said first strip members to said leaves of said binder comprises a pair of third strip members securely mounted to said leaves of said binder and positioned adjacent to said first strip members, and means for hingeably connecting said first strip members to said third strip members along adjacent edges thereof, and wherein said means for hingeably connecting said second strip members to said spine portion of the binder comprises a fourth strip member securely mounted to said spine portion of the binder and positioned adjacent to said second strip members, and means for hingeably connecting said second strip members to said fourth strip member along adjacent edges thereof.

11. An apparatus as defined in claim 10 wherein each said strip member and each said means for hingeably connecting said strip members are formed as an integral, one-piece molded plastic construction.

12. An apparatus for lifting sheets bound within a binder comprising:

a pair of first strip members;

a pair of second strip members positioned adjacent and parallel to each of said respective first strip members;

means for hingeably connecting said first strip members to said respective second strip members along adjacent parallel edges thereof;

a pair of third strip members positioned adjacent to said first strip members and opposite to said second strip members, each of said third strip members being permanently attached to a leaf of said binder;

means for hingeably connecting said third strip members to said respective first strip members along adjacent parallel edges thereof;

a fourth strip member positioned adjacent and parallel to said second strip members and opposite to said first strip members, said fourth strip member being attached to the spine portion of said binder; and means for hingeably connecting said fourth strip member to said second strip members along adjacent parallel edges thereof.

13. An apparatus as defined in claim 7 wherein each said strip member and wherein each said means for hingeably connecting said strip members are formed as a single, integral piece of molded plastic construction.

14. An apparatus as defined in claim 7 wherein each said strip member has a length which essentially corresponds to the length of the spine portion of said binder.

* * * * *